US006094630A

United States Patent [19]

Nomura

[11] Patent Number: 6,094,630

[45] Date of Patent: Jul. 25, 2000

[54] SEQUENTIAL SEARCHING SPEECH CODING DEVICE

[75] Inventor: Toshiyuki Nomura, Tokyo, Japan

[73] Assignee: NEC Corporation, Tokyo, Japan

[21] Appl. No.: 08/760,219

[22] Filed: Dec. 4, 1996

[30] Foreign Application Priority Data

Dec. 6, 1995 [JP] Japan ..... 7-318071

[51] Int. Cl.[7] ..... G10L 3/02

[52] U.S. Cl. ..... 704/230; 704/219

[58] Field of Search ..... 704/211, 219, 704/221, 220, 236, 264, 267, 268, 201, 230

[56] References Cited

U.S. PATENT DOCUMENTS

| | | | |
|---|---|---|---|
| 4,038,495 | 7/1977 | White | 704/220 |
| 4,220,819 | 9/1980 | Atal et al. | 704/219 |
| 4,472,832 | 9/1984 | Atal et al. | 704/221 |
| 4,516,259 | 5/1985 | Yato et al. | 704/220 |
| 4,776,015 | 10/1988 | Takeda et al. | 704/220 |
| 4,829,575 | 5/1989 | Lloyd | 704/242 |
| 4,899,385 | 2/1990 | Ketchum et al. | 704/219 |
| 4,932,061 | 6/1990 | Kroon et al. | 704/219 |
| 5,144,671 | 9/1992 | Mazor et al. | 704/220 |
| 5,327,519 | 7/1994 | Haggvist et al. | 704/219 |
| 5,432,883 | 7/1995 | Yoshihara | 704/219 |
| 5,432,884 | 7/1995 | Kapanen et al. | 704/219 |
| 5,444,816 | 8/1995 | Adoul et al. | 704/219 |
| 5,451,951 | 9/1995 | Elliott et al. | 704/220 |

FOREIGN PATENT DOCUMENTS 0515138 11/1992 European Pat. Off. .

OTHER PUBLICATIONS

Holmes. Speech Synthesis and Recognition. Chapman & Hall. p. 68, 1988.

Parsons. Voice and Speech Processing. mcGraw–Hill. pp. 243–244, 1987.

U. Kipper et al., "High Quality Speech Coding AL 4.8 KB/S Using Multi–Grid Celp Coders", Signal Processing Theories and Applications, vol. 2, No. Conf. 5, XP 000365774, Sep. 18, 1990, pp. 1215–1218.

Bishnu S. Atal et al., "A New Model of LPC Excitation for Producing Natural–Sounding Speech at Low Bit Rates", International Conference on Acoustics, Speech & Signal Processing ICASSP, vol. 1, No. Conf. 7, May 3–5, 1982 pp. 614–617.

S. Taumi et al., "Low–delay CELP with Multi–Pulse VQ and Fast Search for GMS EFR", IEEE International Conference on Acoustics, Speech and Signal Processing Conference Proceedings, vol. 1, XP 002070710, 1996, pp. 562–565.

*Primary Examiner*—Emanuel Todd Voeltz
*Assistant Examiner*—M. David Sofocleous
*Attorney, Agent, or Firm*—Sughrue, Mion, Zinn, Macpeak & Seas, PLLC

[57] ABSTRACT

A speech coding device in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, resulting in obtaining reproduced speech signals with high quality in a small operational amount. In a pulse searcher, a pulse generating section outputs a plurality of pulse strings, and a pulse searching section sequentially searches the pulse strings to determine the positions of the plurality of pulse strings constituting the excitation signal. One pulse searching section searches using a Viterbi algorithm. Another pulse searching section preliminarily searches in a tree shape of pulse position candidates. Another pulse searching section searches every pulse position candidate group.

3 Claims, 4 Drawing Sheets

SEQUENTIAL SEARCHING SPEECH CODING DEVICE

BACKGROUND OF THE INVENTION

The present invention relates to a speech coding device capable of determining an excitation signal so as to minimize distortion between a reproduction speech signal and an input speech signal, and more particularly to an efficient speech coding device for coding speech signals with high speech quality.

DESCRIPTION OF THE RELATED ART

As a conventional coding system for speech signals at low bit rates of equal to or less than 4.8 kbits/sec, for example, a CELP (code-excited linear prediction) coding system has been known, as disclosed in "Code-Excited Linear Prediction: High-Quality Speech At Very Low Bit Rates", by M. R. Schroeder and B. S. Atal, Proc. ICASSP, pp. 937–940, 1985 (the first Document), and "Improved Speech Quality And Efficient Vector Quantization In CELP", by W. B. Kleijin, D. J. Krasinski and R. H. Ketchum, Proc. ICASSP, pp. 155–158, 1988 (the second Document).

In this CELP coding system, when coding on a transmitter side, first, spectral parameters representing spectral characteristics of a speech signal are extracted from the speech signal using a LPC (linear predictive coding) analysis of, for example, every frame of 20 ms composed of the speech signals. Further, the frame is divided into, for example, 5 ms subframes, and parameters (a delay parameter and a gain parameter corresponding to a pitch cycle) are extracted based on an excitation signal every frame using an adaptive codebook.

In the CELP coding system, the speech signals of the above described subframes are predicted from the adaptive codebook, and the optimum random code vector is selected from a random codebook (a vector quantized codebook) consisting of predetermined kinds of noise signals to calculate the optimum gain, resulting in quantizing the excitation signal.

On this occasion, the optimum random code vector is selected so that an error power between the input speech signal and the reproduced speech signal synthesized by considering the selected random code vector as the excitation signal may be minimized. The gain and the index representing the kind of the selected random code vector, and the foregoing spectral parameter and the parameter of the adaptive codebook are combined in a multiplexer to output a combination of the codes from an output terminal for transmitting.

A decoding procedure on a receiver side is conducted in a conventional manner and the detailed description thereof can be omitted for brevity.

Further, in order to reduce a memory amount and an operational amount in the CELP coding system, a conventional fast coding method has been proposed, as disclosed in "Fast CELP Coding Based On Algebraic Codes", by J-P. Adoul, P. Mabilleau, M. Delprat and S. Morissette, Proc. ICASSP, pp. 1957–1960. 1987 (the third document).

Next, a conventional excitation signal search method using pulse strings produced in an algebraic manner as an excitation signal in a CELP coding system will be described.

In this search method, an excitation signal is expressed in the form of a sum of pulse strings selected from a plurality of channels. The pulse strings are selected from pulse candidate positions predetermined for each channel. The amplitude of each pulse is only of a polarity. For example, when a subframe length sampled at 8 kHz is 5 ms (a sample number N=8 k×5 m=40), an excitation signal per subframe is expressed, for example, by a sum of P=5 number of single pulses selected from P=5 number of channels. In this instance, each of the P=5 channels has M (=N/P=40/5)=8 number of predetermined pulse candidate positions.

The optimum excitation signal can be searched so that the distortion between the input speech signal and the reproduced speech signal obtained by exciting a synthetic filter using the excitation signal may be minimized. Now, when using the excitation signal as the pulse string, the minimization of the distortion between the input speech signal and the reproduced speech signal becomes equivalent to the maximization of the following formula (1).

$$E(k) = \frac{\left\{\sum_{i=0}^{P-1} a(i),\ d[m(i)]\right\}^2}{\sum_{i=0}^{P-1} \phi[m(i), m(j)] + 2 \cdot \sum_{i=0}^{P-2} \sum_{j=i+1}^{P-1} a(i), a(j), \phi[m(i), m(j)]} \tag{1}$$

In this formula, a symbol a(i), [i=0, . . . , P−1] represents "1" or "−1", a symbol $\phi$(i, j), [i, j=0, . . . , N−1] represents an auto-correlation function responsive to an impulse in a synthetic filter, and a symbol d(i), [i=0, . . . , N−1] represents a target signal obtained from an input speech signal and an impulse response signal. A symbol k can result from "m(i)" [i=0, . . . , P−1] representing an excitation signal and can be transmitted at "$(1+\log^2 M)\times P$" bits.

The search according to an evaluation function of formula (1) can be carried out sequentially one by one using P-times loops.

In the above conventional speech coding system, the excitation signal is expressed by the pulse string of only the polarity in the search method of the excitation signal. The search of this pulse position is sequentially implemented one by one against all the candidates, and the effort involved in the searching is high.

On the other hand, when performing a preliminary selection of the pulse positions to be searched in order to reduce the effort in searching, the quantizing efficiency deteriorates and the reproduced speech signal quality is degraded.

SUMMARY OF THE INVENTION

It is therefore an object of the present invention to provide a speech coding device in view of the aforementioned problems of the prior art, which is capable of searching the optimum pulse string representing an excitation signal with a low amount of effort, to obtain a reproduction speech with high quality.

In accordance with one aspect of the present invention, there is provided a speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising means for generating a plurality of pulse strings; and means for searching the pulse strings sequentially every pulse string using a Viterbi algorithm to determine the positions of the plurality of pulse strings constituting the excitation signal.

In accordance with another aspect of the present invention, there is provided a speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising means for generating a plurality of pulse strings, pulse position candidates of the pulse strings being expressed in a tree shape; and means for searching the pulse strings sequentially every pulse string by a preliminary searching to determine the positions of the plurality of pulse strings constituting the excitation signal.

In accordance with a further aspect of the present invention, there is provided a speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising means for generating a plurality of pulse strings, pulse position candidates of the pulse strings being divided into groups; and means for searching the pulse strings sequentially every pulse position candidate group to determine the positions of the plurality of pulse strings constituting the excitation signal.

BRIEF DESCRIPTION OF THE DRAWINGS

The objects, features and advantages of the present invention will become more apparent from the consideration of the following detailed description, taken in conjunction with the accompanying drawings, in which.

DESCRIPTION OF THE PREFERRED EMBODIMENTS

Figure 1:
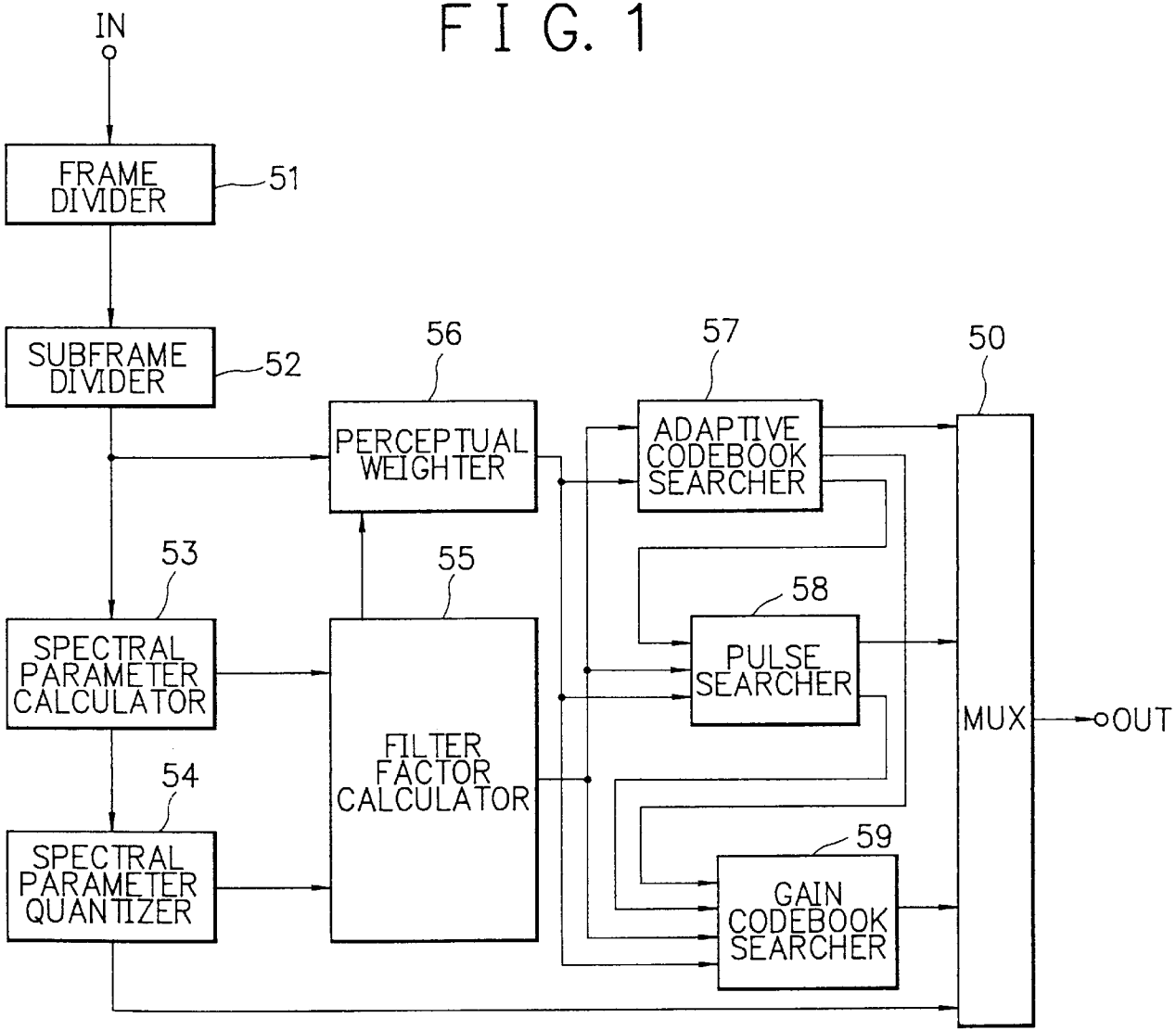
FIG. 1 is a block diagram of a speech coding device according to one embodiment of the present invention.

Referring now to the drawings, in FIG. 1, there is shown a speech coding device according to one embodiment of the present invention.

In FIG. 1, the speech coding device comprises a frame divider 51, a subframe divider 52, a spectral parameter calculator 53, a spectral parameter quantizer 54, a filter factor calculator 55 of a (human auditory) perceptual weighting synthetic filter, a (human auditory) perceptual weighter 56, an adaptive codebook searcher 57, a pulse searcher 58, a gain codebook searcher 59, and a multiplexer (MUX) 50.

More specifically, first, speech signals input from an input terminal are divided, for example, every frame of 20 ms in the frame divider 51 and are further divided, for example, every subframe of 5 ms shorter than 20 ms of the frame in the subframe divider 52.

The spectral parameter calculator 53 cuts out speech using a frame of, for example, 10 ms longer than a subframe length, which in this case is 5 ms due to sampling at 8 kHz with a sampling number N=40) against the speech signals of at least one subframe and it is assumed that the spectral parameter calculator 53 calculates spectral parameters by a predetermined dimensional number L of, for example, ten degrees (L=10).

For the calculation of the spectral parameters, a well-known LPC analysis can be used.

Further, the spectral parameter calculator 53 converts linear predictive factors a(i), [i=1, . . . , L] into LSP (line spectrum pair) parameters adaptive to a quantization and an interpolation. For the conversion from the linear predictive factors into the LSP parameters, a paper "Speech Data Compression By LSP Speech Analysis-Synthesis Technique", by N. Sugamura and F. Itakura, IECE J64-A, pp. 599–606, 1981 (the fourth document) can be used. The linear predictive factors are output to the filter factor calculator 55, and the LSP parameters are to the spectral parameter quantizer 54.

The spectral parameter quantizer 54 quantizes the LSP parameters effectively. For this quantization of the LSP parameters, well-known quantizing methods can be used. For example, Japanese Patent Application Laid-Open Publication No. 4-171500 (the fifth document) or the like can be referred, and the description thereof can be omitted for brevity. The spectral parameter quantizer 54 further converts the quantized LSP parameters into the linear predictive factors a(i), [i=1, . . . , L] to output the obtained linear predictive factors to the filter factor calculator 55 and also outputs codes representing code vectors of the quantized LSP parameters to the multiplexer 50.

The filter factor calculator 55 inputs the linear predictive factors before the quantization from the spectral parameter calculator 53 and the quantized linear predictive factors from the spectral parameter quantizer 54 and calculates factors of a perceptual weighting filter expressed by formula (2) to output the calculated factors to the perceptual weighter 56. The filter factor calculator 55 further outputs factors of a perceptual weighting synthetic filter consisting of a linear predictive synthetic filter and a perceptual weighting filter to the adaptive codebook searcher 57, and the pulse searcher 58 and the gain codebook searcher 59.

$$Hw(z) = \frac{1 - \sum_{i=1}^{L} a(i),\ R2^{i},\ z^{-i}}{1 - \sum_{i=1}^{L} a(i),\ R1^{i},\ z^{-i}} \tag{2}$$

In this formula, R1 and R2 represent weighting factors for controlling a perceptual weighting amount, and, for example, R1=0.9 and R2=1.0 are applied.

The perceptual weighter 56 reproduces the weighting filter from the factors of the perceptual weighting filter supplied from the filter factor calculator 55 and weights the input signal to output perceptual weighted input signal X(n) to the adaptive codebook searcher 57, the pulse searcher 58 and the gain codebook searcher 59.

The adaptive codebook searcher 57 cuts out a segment of a delay d (a pitch cycle) from a past excitation signal and repeatedly connects the cutout segments until the connected segments have the subframe length N to produce the adaptive code vector Ad(n) corresponding to the delay d, and selects the pitch cycle d and the adaptive code vector Ad(n) so that an error power between a perceptual weighting input signal and a perceptual weighting synthetic signal obtained using the produced adaptive code vector Ad(n) may be minimized.

Further, the adaptive codebook searcher 57 outputs a code representing the selected pitch cycle d to the multiplexer 50, outputs the selected adaptive code vector Ad(n) to the gain codebook searcher 59, and outputs the perceptual-weighted and selected adaptive code vector SAd(n) to the pulse searcher 58.

The pulse searcher 58 calculates the optimum pulse string Cj(n) using the factor of the perceptual weighting synthetic filter, the perceptual weighted input signal X(n), and the perceptual-weighted and selected adaptive code vector SAd (n) and outputs the calculated optimum pulse string Cj(n) to the gain codebook searcher 59 and the multiplexer 50.

According to the present invention, the pulse searcher 58 includes a plurality of embodiments and their detailed description will be described later.

The gain codebook searcher 59 inputs the selected adaptive code vector Ad(n) from the adaptive codebook searcher 57, the optimum pulse string Cj(n) from the pulse searcher 58, the perceptual weighted input signal X(n) from the perceptual weighter 56 and the factors of the perceptual weighting synthetic filter from the filter factor calculator 55, and produces the perceptual weighting synthetic filter.

The gain codebook searcher 59 then calculates an excitation signal Ek(n) as a linear sum of the adaptive code vector Ad(n) and the optimum pulse string Cj(n), as expressed in formula (3), and selects a gain code vector so that an error power between the perceptual weighted input signal and the perceptual weighted synthetic signal, obtained by driving the perceptual weighting synthetic filter using the calculated excitation signal Ek(n), may be minimized. The gain codebook searcher 59 outputs the selected gain code vector to the multiplexer 50.

$$Ek(n)=Gk(1)\cdot Ad(n)+Gk(2)\cdot Cj(n) \tag{3}$$

In formula (3). Gk(1) and Gk(2) represent k-th two-dimensional gain code vectors.

The multiplexer 50 inputs the codes representing code vectors of the quantized LSP parameters from the spectral parameter quantizer 54, the code representing the selected pitch cycle d from the adaptive codebook searcher 57, the code representing the pulse string from the pulse searcher 58 and the code representing the gain code vector from the gain codebook searcher 59, and combines the input codes to output the combined codes to an output terminal.

Figure 2:
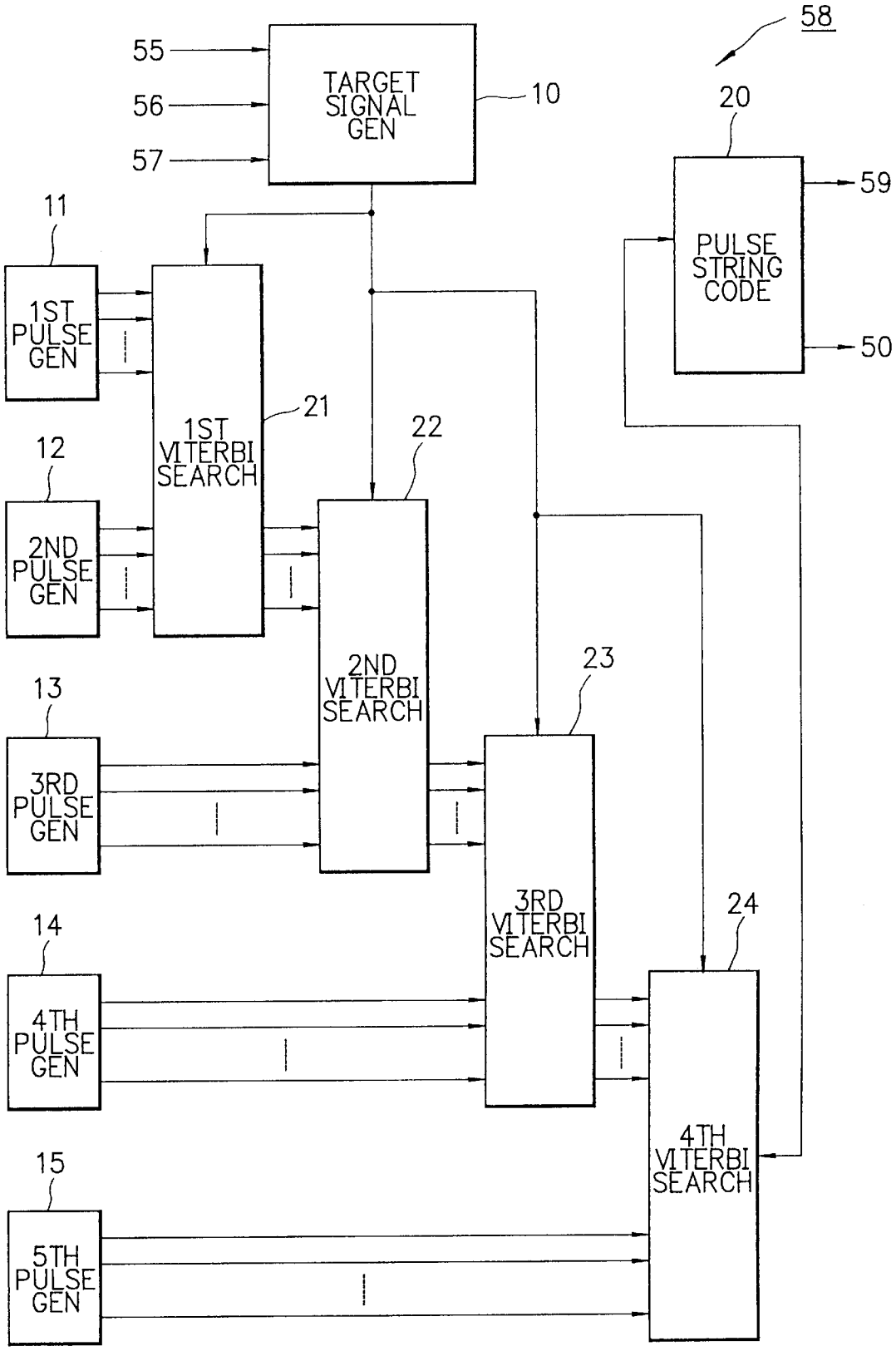
FIG. 2 is a block diagram of a first embodiment of a pulse searcher shown in FIG. 1.
Figure 3:
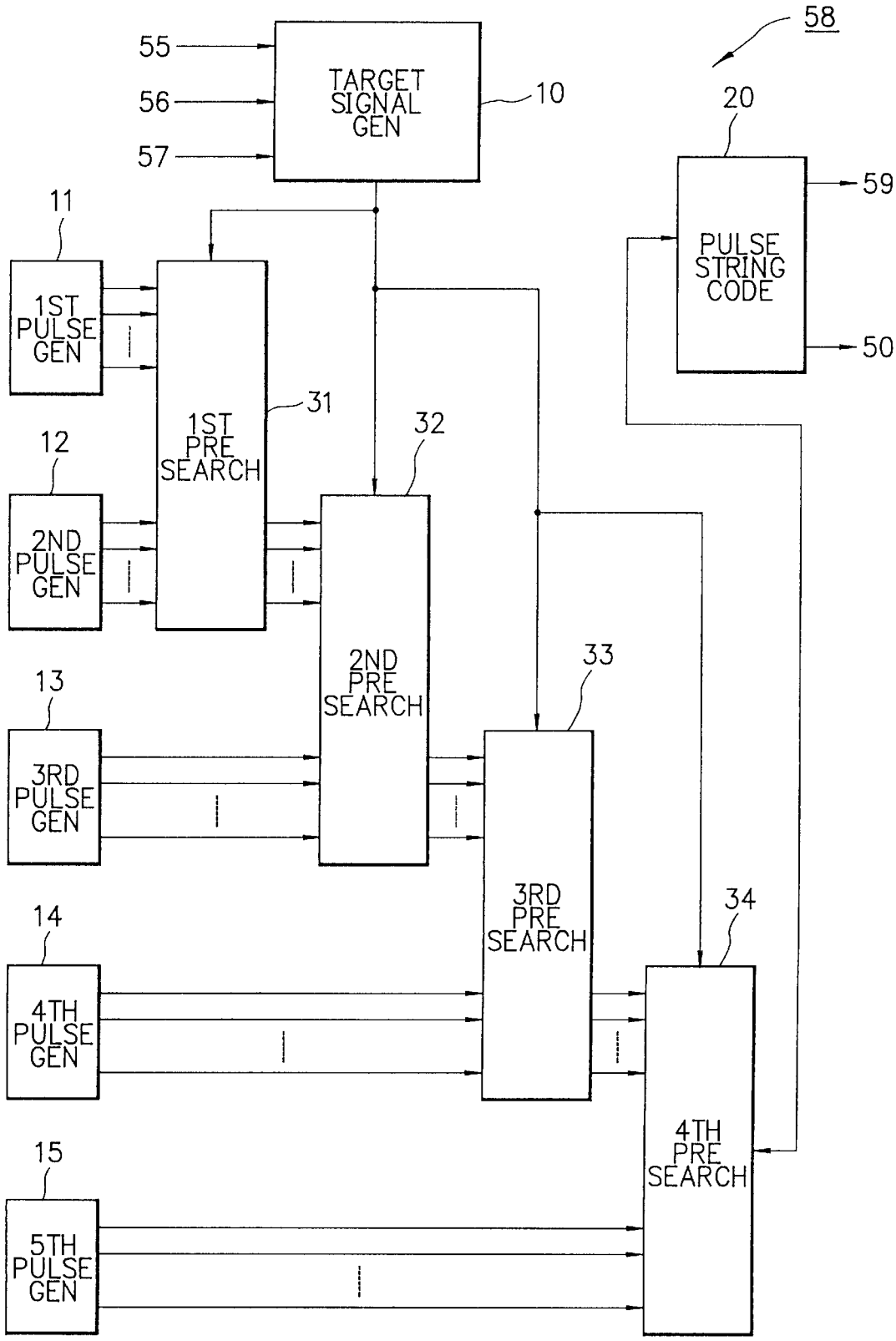
FIG. 3 is a block diagram of a second embodiment of a pulse searcher shown in FIG. 1.
Figure 4:
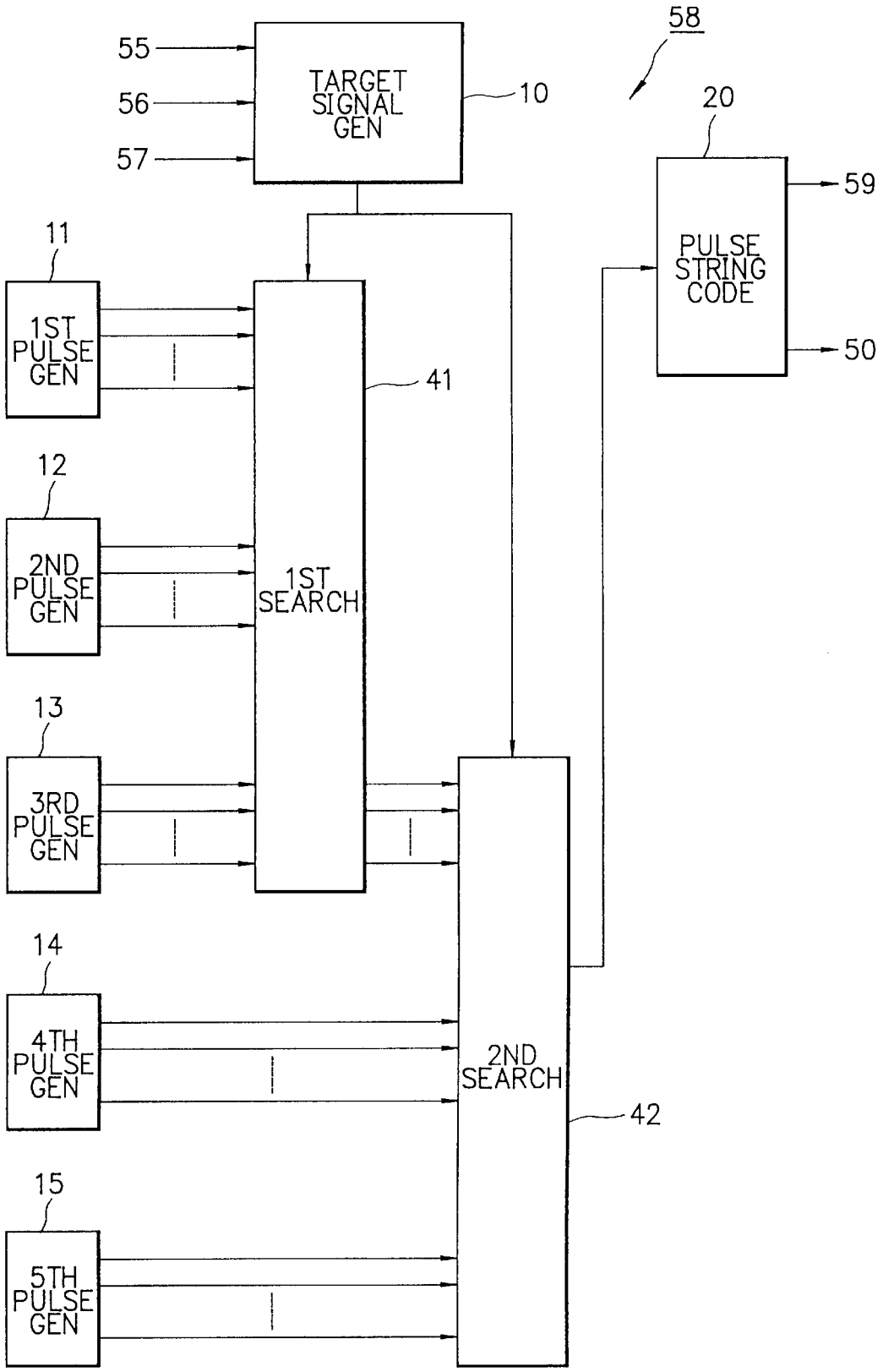
FIG. 4 is a block diagram of a third embodiment of a pulse searcher shown in FIG. 1.

FIGS. 2 to 4 show the first to third embodiments of the pulse searcher 58 of the speech coding device shown in FIG. 1 corresponding to the speech coding device according to the first to third embodiments of the present invention.

The first embodiment of the pulse searcher 58 of the speech coding device shown in FIG. 1 will be described with reference to FIG. 2.

In FIG. 2, the pulse searcher 58 includes a target signal generating circuit 10, first, second, third, fourth and fifth pulse generating circuits 11 to 15, a pulse string coding circuit 20, and first, second, third and fourth Viterbi searching circuits 21 to 24.

The pulse searcher 58 produces an excitation signal which is expressed as a sum of pulse strings selected from a plurality of channels. The pulse strings are selected from pulse position candidates predetermined for each channel. The amplitude of each pulse is only of a polarity. For example, in the case of a subframe length of 5 ms and sampling at 8 kHz (a sampling number N=40), it is assumed that an excitation signal per subframe is expressed as a sum of, for example, P (=5) number of single pulses selected from P (=5) number of channels. In this instance, each of the P (=5) number of channels has predetermined M (=N/P=40/5=8) number of pulse position candidates.

In FIG. 2, the target signal generating circuit 10 inputs the factors of the perceptual weighting synthetic filter and constitutes the perceptual weighting synthetic filter. Further, the target signal generating circuit 10 inputs the perceptual weighted input signal X(n) from the perceptual weighter 56 and the perceptual-weighted and selected adaptive code vector SAd(n) from the adaptive codebook searcher 57 and calculates an error signal z(n) according to formula (4) wherein a symbol G is expressed by formula (5).

$$z(n) = X(n) - G\cdot SAd(n) \tag{4}$$

$$G = \frac{\sum_{n=0}^{N-1} X(n)SAd(n)}{\sum_{i=0}^{N-1} SAd(n)^2} \tag{5}$$

Further, the target signal generating circuit 10 filters the error signal z(n) backwards using the perceptual weighting synthetic filter to prepare a target signal d(n), produces an auto-correlation function $\phi(i, j)$ responsive to an impulse in the perceptual weighting synthetic filter, and outputs the target signal d(n) and the auto-correlation function $\phi(i, j)$ to the first, second, third and fourth Viterbi searching circuits 21, 22, 23 and 24.

The first pulse generating circuit 11 places single pulses against predetermined 8 pulse position candidates (e.g., N=0, 5, 10, 15, 20, 25, 30, 35) and outputs these pulses to the first Viterbi searching circuit 21.

The second pulse generating circuit 12 places single pulses against predetermined 8 pulse position candidates (e.g., N=1, 6, 11, 16, 21, 26, 31, 36) and similar to the first pulse generating circuit 11, outputs these pulses to the first Viterbi searching circuit 21.

The third pulse generating circuit 13 places single pulses against predetermined 8 pulse position candidates (e.g., N=2, 7, 12, 17, 22, 27, 32, 37) and outputs these pulses to the second Viterbi searching circuit 22.

The fourth pulse generating circuit 14 places single pulses against predetermined 8 pulse position candidates (e.g., N=3, 8, 13, 18, 23, 28, 33, 38) and outputs these pulses to the third Viterbi searching circuit 23.

Similarly, the fifth pulse generating circuit 15 places single pulses against predetermined 8 pulse position candidates (e.g., N=4, 9, 14, 19, 24, 29, 34, 39) and outputs these pulses to the fourth Viterbi searching circuit 24.

The pulse position candidates in the first to fifth pulse generating circuits 11 to 15 are one example and, of course, another positioning can be possible in the pulse position candidates.

The searching of the pulse strings in the first to fourth viterbi searching circuits 21 to 24 is carried out by selecting the optimum combination of the signals supplied from the two pulse generating circuits on the basis of a Viterbi algorithm.

In the first Viterbi searching circuit 21, when the 8 pulse signals (the pulse position m(1)=1, 6, 11, 16, 21, 26, 31, 36) output from the second pulse generating circuit 12 are placed, the optimum combinations with the 8 pulse signals (the pulse position m(0)=0, 5, 10, 15, 20, 25, 30, 35) output from the first pulse generating circuit 11 are selected based on the Viterbi algorithm.

That is, the first Viterbi searching circuit 21 adds the 8 pulse signals output from the first pulse generating circuit 11 to each of the 8 pulse signals output from the second pulse generating circuit 12, and selects one pulse signal from the obtained 8 pulse signals so that an evaluation value E(k) (in this case, P=2) in formula (1) may be maximum. As a result, the 8 selected pulse signals including the pulse position candidates of the second pulse generating circuit 12 are obtained as the candidates and these candidates are output to the second Viterbi searching circuit 22.

In the second Viterbi searching circuit 22, when the 8 pulse signals (the pulse positions m(2)=2, 7, 12, 17, 22, 27, 32, 37) output from the third pulse generating circuit 13 are placed, the optimum combinations with the 8 pulse signals output from the first Viterbi searching circuit 21 are selected (in this case, P=3) in the same manner as described above, and the selected pulse signals including the pulse position candidates of the third pulse generating circuit 13, obtained as the candidates are output to the third Viterbi searching circuit 23.

In the third Viterbi searching circuit 23, a searching is executed (in this case, P=4) in the same manner as described above, and the selected pulse signals including the pulse position candidates (the pulse position m(3)=3, 8, 13, 18, 23, 28, 33, 38) of the fourth pulse generating circuit 14 are obtained as the candidates, and these candidates are output to the fourth Viterbi searching circuit 24.

Similarly, in the fourth Viterbi searching circuit 24, a searching is carried out, and the selected pulse signals including the pulse position candidates (the pulse position m(4)=4, 9, 14, 19, 24, 29, 34, 39) of the fifth pulse generating circuit 15 are obtained as the candidates, and one pulse signal is finally selected from the obtained signals so that the evaluation value E(k) (in this case, P=5) in formula (1) may be maximum. The selected pulse signal is output to the pulse string coding circuit 20.

In this embodiment, any connection between the pulse generating circuits 11 to 15 and the Viterbi searching circuits 21 to 24 can be possible. For example, besides the above described connection, priority of each pulse generating circuit is determined by the evaluation value E(k) (in this case, P=1) in formula (1), and the pulse generating circuits 11 to 15 may be connected to the Viterbi searching circuits 21 to 24 in the priority order.

In the pulse string coding circuit 20. codes are produced from the P (=5) number of pulse positions constituting the pulse signal input from the fourth Viterbi searching circuit 24. The produced codes are output to the multiplexer 50 and the pulse signal is supplied to the gain codebook searcher 59.

The second embodiment of the pulse searcher 58 of the speech coding device shown in FIG. 1 will be described with reference to FIG. 3.

In FIG. 3, the pulse searcher 58 includes a target signal generating circuit 10. first, second, third, fourth and fifth pulse generating circuits 11 to 15, a pulse string coding circuit 20, and first, second, third and fourth preliminary searching circuits 31 to 34.

In this embodiment, as shown in FIG. 3, the second embodiment of the pulse searcher 58 has the same construction as the first embodiment shown in FIG. 2, except that the first to fourth preliminary searching circuits 31 to 34 are used instead of the first to fourth Viterbi searching circuits 21 to 24. Thus, the description of the same parts as those of the first embodiment can be omitted for brevity.

The target signal generating circuit 10 outputs the target signal d(n) and the auto-correlation function $\phi(i, j)$ to the first, second, third and fourth preliminary searching circuits 31, 32, 33 and 34.

The first, second, third, fourth and fifth pulse generating circuits 11 to 15 output the pulses to the first, first, second, third and fourth preliminary searching circuits 31 to 34, respectively, in the same manner as the first embodiment shown in FIG. 2.

In this embodiment, a search of pulse strings is carried out by placing the pulse strings in a tree shape obtained by increasing one pulse every channel and by performing a preliminary selection of candidates at every pulse increase.

The first preliminary searching circuit 31 preliminarily selects Q (=8) number of pulse signals from the $M^2$ ($=8^2=64$) number of pulse signals of a combination of M (=8) number of pulse signals (the pulse position m(0)=0, 5, 10, 15, 20, 25, 30, 35) output from the first pulse generating circuit 11 and of M (=8) number of pulse signals (the pulse position m(1)=1, 6, 11, 16, 21, 26, 31, 36) output from the second pulse generating circuit 12 so that the evaluation value E(k) (in this case, P=2) in formula (1) may be maximum, and outputs the selected pulse signals to the second preliminary searching circuit 32.

The second preliminary searching circuit 32 preliminarily selects Q (=8) number of pulse signals from the Q×M (=8×8=64) number of pulse signals of a combination of M (=8) number of pulse signals (the pulse position m(2)=2, 7, 12, 17, 22, 27, 32, 37) output from the third pulse generating circuit 13 and of Q (=8) number of pulse signals preliminarily selected in the first preliminary searching circuit 31 so that the evaluation value E(k) (in this case, P=3) in formula (1) may be maximum, and outputs the selected pulse signals to the third preliminary searching circuit 33.

In the third preliminary searching circuit 33 a preliminary searching is implemented in the same manner as described above, to select the Q (=8) number of pulse signals from the Q×M (=64) number of pulse signals including the signals (the pulse position m(3)=3, 8, 13, 18, 23, 28, 33, 38) and the signals preliminarily selected in the second preliminary searching circuit 32 so that the evaluation value E(k) (in this case, P=4) in formula (1) may be maximum, and the selected pulse signals are output to the fourth preliminary searching circuit 34.

Similarly, the fourth preliminary searching circuit 34 executes a preliminary search so as to finally select one pulse signal from the Q×M (=64) number of pulse signals including the signals (the pulse position m(4)=4, 9, 14, 19, 24, 29, 34, 39) and the signals preliminarily selected in the third preliminary searching circuit 33 so that the evaluation value E(k) (in this case, P=5) in formula (1) may be maximum. The selected pulse signal is output to the pulse string coding circuit 20.

The pulse string coding circuit 20 outputs the produced codes to the multiplexer 50 and the selected pulse signal to the gain codebook searcher 59 in the same manner as the first embodiment described above.

The third embodiment of the pulse searcher 58 of the speech coding device shown in FIG. 1 will be described with reference to FIG. 4.

In FIG. 4, the pulse searcher 58 includes a target signal generating circuit 10, first, second, third, fourth and fifth pulse generating circuits 11 to 15, a pulse string coding circuit 20, and first and second searching circuits 41 to 42.

In this embodiment, as shown in FIG. 4, the third embodiment of the pulse searcher 58 has the same construction as the second embodiment shown in FIG. 3, except that the first and second searching circuits 41 to 42 are used instead of the first to fourth preliminary searching circuits 31 to 34. Thus, the description of the same parts as those of the second embodiment can be omitted for brevity.

The target signal generating circuit 10 outputs the target signal d(n) and the auto-correlation function $\phi(i, j)$ to the first and second searching circuits 41 and 42.

The first to third pulse generating circuits 11 to 13 output the pulses to the first searching circuits 41 and the fourth and fifth pulse generating circuits 14 and 15 output the pulses to the second searching circuits 42.

The first searching circuit 41 preliminarily selects, for example, Q (=8) number of pulse signals from the $M^3$ ($=8^3=512$) number of pulse signals of a combination of M (=8) number of pulse signals (the pulse position m(0)=0, 5, 10, 15, 20, 25, 30, 35) output from the first pulse generating circuit 11, of M (=8) number of pulse signals (the pulse position m(1)=1, 6, 11, 16, 21, 26, 31, 36) output from the second pulse generating circuit 12, and of M (=8) number of pulse signals (the pulse position m(2)=2, 7, 12, 17, 22, 27, 32, 37) output from the third pulse generating circuit 13 so that the evaluation value E(k) (in this case, P=3) in formula (1) may be maximum, and the selected 8 pulse signals are output to the second searching circuit 42.

The second searching circuit 42 finally selects one pulse signal from the $Q\times M^2$ ($=8\times 8^2=512$) number of pulse signals of a combination of M (=8) number of pulse signals (the pulse position m(3)=3, 8, 13, 18, 23, 28, 33, 38) output from the fourth pulse generating circuit 14, of M (=8) number of pulse signals (the pulse position m(4)=4, 9, 14, 19, 24, 29, 34, 39) output from the fifth pulse generating circuit 15, and of Q (=8) number of pulse signals preliminarily selected in the first searching circuit 41 so that the evaluation value E(k) (in this case, P=5) in formula (1) may be maximum. The selected pulse signal is output to the pulse string coding circuit 20.

The pulse string coding circuit 20 outputs the produced codes to the multiplexer 50 and the selected pulse signal to the gain codebook searcher 59 in the same manner as the first embodiment described above.

Further, in the third embodiment, a plurality of Viterbi searching circuits used in the first embodiment or a plurality of preliminary searching circuits used in the second embodiment may be used for the searching circuits to which a plurality of pulse generating circuits are connected.

As described above, according to the present invention, in a speech coding device including a plurality of pulse searching circuits, when coding speech signals, position candidates of a plurality of pulse strings constituting the excitation signal are divided into groups, and the pulse searching circuits carry out the searching of every group to determine the positions of the plurality of pulse strings. Hence, in the searching of the pulse strings constituting the excitation signal, the operational amount can be reduced without deteriorating reproduction speech signal quality. resulting in efficiently reproduced speech with high quality.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising:

means for generating a plurality of pulse strings; and means for searching the pulse strings sequentially every pulse string using a Viterbi algorithm to determine the positions of the plurality of pulse strings constituting the excitation signal.

2. A speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising:

means for generating a plurality of pulse strings, pulse position candidates of the pulse strings being expressed in a tree shape; and means for searching the pulse strings sequentially every pulse string by a preliminary searching to determine the positions of the plurality of pulse strings constituting the multi-pulse speech signal.

3. A speech coding device, in which an excitation signal of speech signals is expressed as a sum of a plurality of pulse strings, and positions of the pulse strings are selected from predetermined pulse position candidates to determine the excitation signal so that distortion between an input speech signal and a reproduced speech signal obtained by exciting a synthetic filter using the excitation signal may be minimized, comprising:

means for generating a plurality of pulse strings, pulse position candidates of the pulse strings being divided into groups; and means for searching the pulse strings sequentially every pulse position candidate group to determine the positions of the plurality of pulse strings constituting the multi-pulse speech signal.

* * * * *